United States Patent [19]

Murray

[11] 3,982,799

[45] Sept. 28, 1976

[54] DISH STABILIZING MECHANISMS FOR DISH-WASHING MACHINES

[76] Inventor: James M. Murray, 9129 S. Crescent Court, Oak Lawn, Ill. 60453

[22] Filed: May 27, 1975

[21] Appl. No.: 581,145

[52] U.S. Cl. ..... 312/270; 134/199; 312/291

[51] Int. Cl.[2] ..... B08B 3/02; B08B 9/08

[58] Field of Search ..... 312/23, 127, 229, 270, 312/271, 291–296, 297, 309, 351, 352; 211/181; 134/131, 135, 199; 102/22 BM; 61/37, 38

[56] References Cited

UNITED STATES PATENTS 1,120,028 12/1914 Cole ..... 312/270

3,616,806 11/1971 Randall ..... 134/199

OTHER PUBLICATIONS

"Engineering News–Record" Aug. 12, 1954 p. 25, Col. 1 and 2.

*Primary Examiner*—Casmir A. Nunberg

[57] ABSTRACT

Upper and lower mesh-units are installed in a dish washing machine above the spaces into which work-baskets containing dishes to be washed are insertible when the door of the machine is open. A mechanism between the door and the mesh units allows them to descend into the work-baskets as the door is closed. The meshes carried by the mesh-units then drape over and between the dishes to hold them apart and against turning during the dish washing operation.

2 Claims, 4 Drawing Figures

Fig. 1.
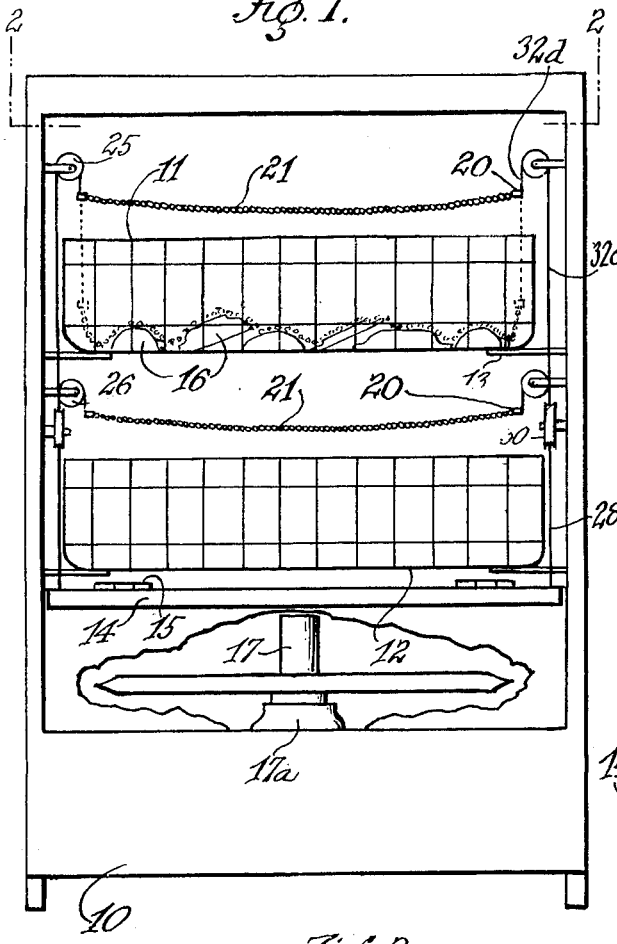
Fig. 2.
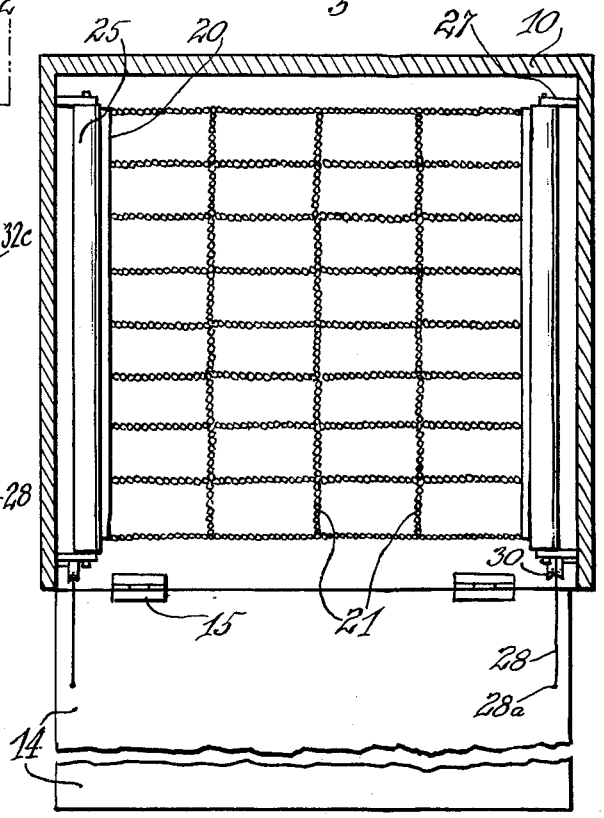
Fig 3.
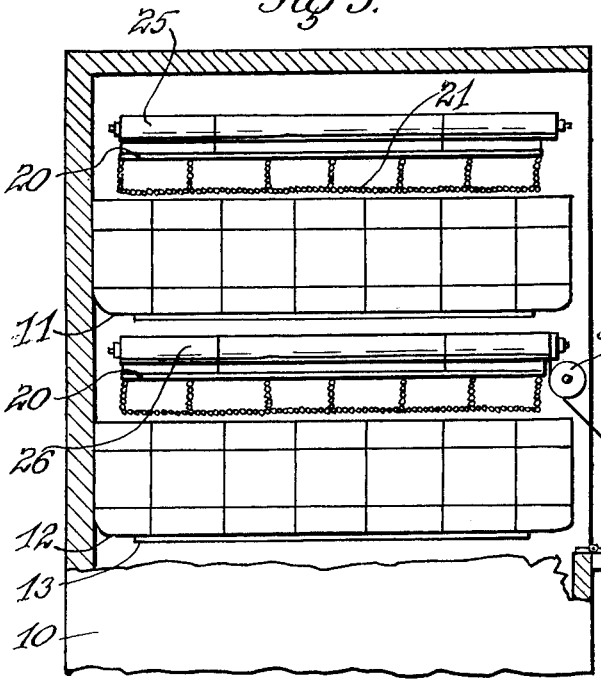
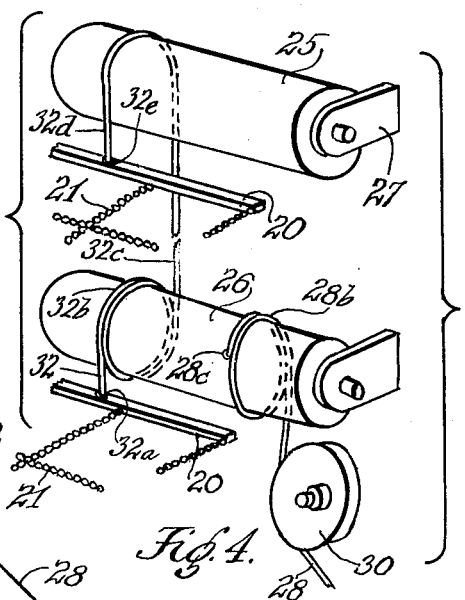
Fig. 4.

DISH STABILIZING MECHANISMS FOR DISH-WASHING MACHINES

My invention relates to the distributed placement of dishes in the work-basket of a dish-washing machine, and more particularly to the maintenance of the dishes as deposited for efficient cleaning during the dish washing operation. At such time cleaning solutions in jet form exert upward and lateral pressure on the dishes, and there is therefore a tendency for them to turn, collide and even to cause damage to some, such as in the case of delicate porcelain or thin glassware. Also, for proper cleaning in a dish-washing machine the dishes are laid with hollows on the under side for direct impact by the jets of cleaning solution. Therefore, such impact often causes the dishes to turn with their hollows sidewise or up and therefore away from the jets of cleaning solution. In view of these conditions, an invention I have covered in another patent application is provided, and is in the nature of an open mesh-unit designed to cover the dishes in the work-basket, hold them in a manner to resist the force of the cleaning solution jets, and allow the latter to wash the dishes efficiently.

Usually, a dish-washing machine has the capacity to receive a pair of vertically-spaced work-baskets, these being slid into the machine from the front when the door has been opened. In it one object of the present invention to install a pair of mesh-units above the spaces for the work-baskets as a part of the dish-washing machine, support them in elevated position while the door of the machine is open preparatory to the insertion of one or both work-baskets loaded with dishes for a dish-washing operation, and cause the closing of the door to lower the mesh-units into the work-baskets and the dish-protecting positions mentioned above in readiness to proceed with the dish washing operation.

A further object is to extend a suitable mechanism from the door of the dish-washing machine to the mesh-units, which allows them to be lowered as stated on the closing of the door, and to be raised back to the elevated position when the door is again opened.

A still further object is to provide a mechanism which will allow the mesh-units to descend by their own weight to engage the dishes as stated when the door is closed, but to procure the positive lifting of the mesh-units when the door is again opened.

A final object is to provide a mesh-controlling installation which is fully automatic, is out of the way for the full insertion or removal of either work-basket when the machine door is open, and is suitable for building it as part of or installed in a conventional dish-washing machine.

A better understanding of the invention may be gained by reference to the accompanying drawing, in which—

FIG. 1 is a frontal interior view of a dish-washing machine with the door swung open to horizontal position, and showing a pair of mesh-units installed;

FIG. 2 is a section on the line 2—2 of FIG. 1, with part of the door broken away;

FIG. 3 is an inside view of FIG. 1 from the left; and

FIG. 4 is perspective view of the mesh-unit operating mechanism in the right-hand side of FIG. 3.

Referring specifically to the drawing, 10 denotes a typical dish-washing machine with upper and lower work-baskets 11 and 12 slidable in or out of the machine on suitable brackets 13. The door 14 of a conventional dish-washing machine may be opened in downward direction on hinges 15, and comes to rest in the horizontal position shown.

The drawing shows the work-baskets inserted in the machine, the upper one 11 containing a load of dishes 16 to be cleaned. The dishes are positioned face-down, as mentioned before, so that they may receive jets of a cleaning solution from the nozzle 17 of a container 17*a* in the lower part of the machine.

Two mesh-units 20 are shown, one above each work-basket. Each mesh unit is composed of parallel end-bars between which is suspended a limp mesh 21. The weight of each mesh unit is sufficient to keep it undisturbed by the upward passage of cleaning fluid jets from the nozzle 17. Also, the mesh links are of any suitably for for draped engagement with the dishes. Full lines show the mesh units in elevated positions where they allow ample head-room for the insertion or removal of the work-baskets. However, when the door is closed the mesh-units are caused to descend and come to rest close to the bottom of the work-baskets or on the dishes 16, as indicated by finely-dotted lines in FIG. 1. The dishes are now ready for the washing operation.

The closing movement of the door 14 actuates a mechanism which allows the mesh-units to descend as described by their own weight. A magnified view of the right-hand portion of the mechanism is shown in FIG. 4. FIGS. 1 to 3 show that a pair of upper, horizontal rollers 25 and a pair of lower rollers 26 are positioned at the sides of the machine, being journaled in brackets 27 carried by the side walls of the machine. The set of rollers on each side thereof is designed to be activated by a draw cord 28 whose lower end is suitably attached to the inner side of the door 14 as indicated at 28a. The cord on the right is noted as rising behind a guide wheel 30 journaled along the related side wall of the machine. The guide wheel is directly below the related roller 26; and the cord 28 is coiled from behind to encircle the roller as shown at 28b and terminate attached to the same, as indicated at 28*c*.

FIG. 4 shows the frontal, right-hand portion of the lower mesh-unit 20, and that a cord 32 is attached to it at 32*a* and rises in front of the roller 26 to encircle the same as indicated at 32*b* and rise from behind the roller to a position behind the upper roller 25, as seen at 32*c*. Here the cord is trained in forward direction to hook over the roller and terminate with a downward portion 32*d* which is fastened to the frontal right-hand portion of the upper mesh unit 20 as indicated at 32*e*. The cord 32 as trained, and its connections to the mesh units, are duplicated in the left-hand side of the machine.

It is now apparent that the cords 32 suspend the mesh-units as shown — above the work-baskets — while the door of the machine is down — that is, in the open position. Because of their weight, the suspension of the mesh-units is strained and taut from the door. Now, when the latter is raised in the closing direction with relaxing effect on the cords 28, this permits the mesh-units to descend as they draw on the cords 32 and rotate the rollers on the right in counter-clockwise direction and those on the left in clockwise direction. The slack cords 28 are therefore taken up and become wound on the rollers 26. The result is that the meshes will settle only by their own weight into engagement with the dishes, and therefore cause them no harm. It is now obvious, at the end of the dish-washing operation, that drawing the door open will reverse the rotation of the described mechanism and raise the mesh-units to their initial positions clear of the work-baskets. Consequently, the action of the mechanism is only positive when the mesh-units are lifted from the dishes.

The aforesaid cord mechanism has been illustrated and described as a simple and very inexpensive way to operate the mesh-units automatically in conjunction with the handling of the door. However, it is conceivable that other mechanical, electrical or pneumatic means could be devised to accomplish the same effect, one system found more efficient or more desirable than another. However, the principle of the invention — to obtain the automatic protection of the dishes during the washing operation when the door of the machine is closed — will remain the same.

I claim:

1. In a dish washing machine having a door and at least one work-basket for dishes to be washed, a mesh-unit located above the space into which the work-basket is insertible when the door is open, and means between the door and the mesh-unit causing the latter to descend into the work-basket as the door is closed, the mesh then draping over and between the dishes to hold them apart and against turning during the dish washing operation, the mesh-unit having supporting bars opposite the sides of the machine, and said mechanism comprising horizontal rollers journaled near such sides, and cords leading from the door and trained over the rollers to connect with the supporting bars and suspend the mesh-unit from the cords.

2. The structure of claim 1, where the door is swung down when open, idlers in the machine below the rollers, and the cords led under the idlers to rise for training over the rollers.

* * * * *